US005429146A

United States Patent [19]

Graf et al.

[11] Patent Number: 5,429,146

[45] Date of Patent: Jul. 4, 1995

[54] DISHWASHER CONNECTABLE FOR SINGLE-PHASE ALTERNATING CURRENT CONNECTION

[75] Inventors: Richard Graf; Uwe Kampet; Bernd-Peter Herrmann, all of Berlin, Germany

[73] Assignee: Bosch-Siemens Hausgeraete GmbH, Munich, Germany

[21] Appl. No.: 107,229

[22] Filed: Aug. 16, 1993

[30] Foreign Application Priority Data

Aug. 14, 1992 [DE] Germany ..... 42 26 965.2

[51] Int. Cl.[6] ..... B08B 3/02

[52] U.S. Cl. ..... 134/58 D; 134/200

[58] Field of Search ..... 134/57 D, 56 D, 58 D, 134/200; 68/12.11, 12.16, 12.17, 12.02; 318/11, 768, 781, 786

[56] References Cited

U.S. PATENT DOCUMENTS

| | | | |
|---|---|---|---|
| 3,835,356 | 9/1974 | Soderholm | 318/768 |
| 4,713,744 | 12/1987 | Coston | 318/768 X |
| 4,777,421 | 10/1988 | West | 318/768 |
| 4,978,894 | 12/1990 | Takahara | 318/768 |
| 4,986,092 | 1/1991 | Sood et al. | 68/12.16 |
| 4,992,718 | 2/1991 | Kumaki | 318/768 |
| 5,017,852 | 5/1991 | Nagata et al. | 134/57 D |
| 5,065,305 | 11/1991 | Rich | 318/768 X |
| 5,146,146 | 9/1992 | Samann | 318/768 |
| 5,272,616 | 12/1993 | Diyan et al. | 318/768 |

*Primary Examiner*—Frankie L. Stinson

*Attorney, Agent, or Firm*—Herbert L. Lerner; Laurence A. Greenberg

[57] ABSTRACT

A dishwasher equipped for single-phase alternating current connection, in particular a dishwasher for typical designated use in a household, includes a recirculating pump for wash water and rinse water with which items to be cleaned are acted upon under a spray pressure. A three-phase rotary current motor drives the recirculating pump. An electronically controlled single-phase AC/three-phase rotary current/frequency inverter impresses current on the three-phase rotary current motor.

4 Claims, 1 Drawing Sheet

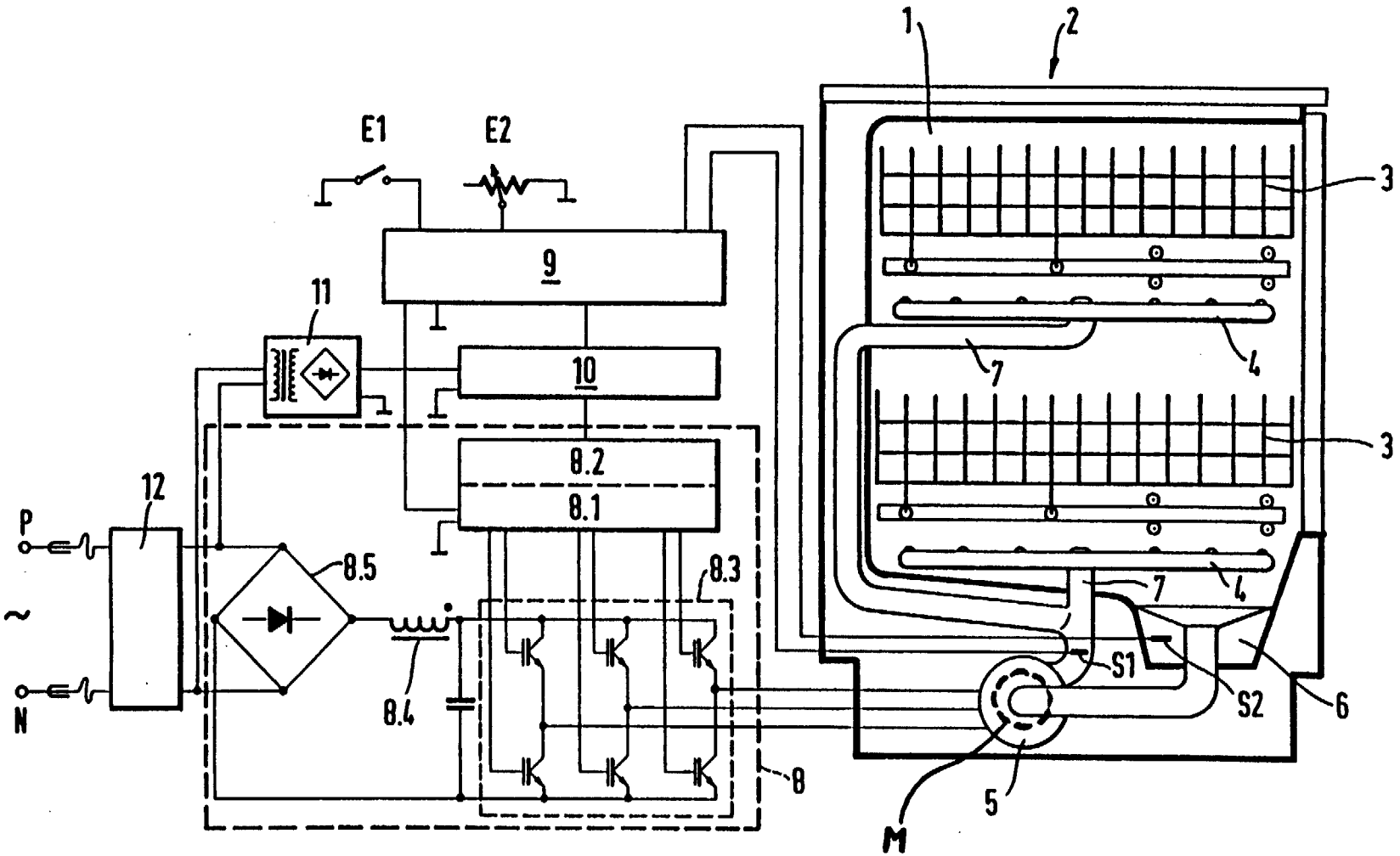
1
2
3
3
4
4
5
6
7
7
S1
S2
M
8
8.1
8.2
8.3
8.4
8.5
9
10
11
12
E1
E2
P
N
~

DISHWASHER CONNECTABLE FOR SINGLE-PHASE ALTERNATING CURRENT CONNECTION

BACKGROUND OF THE INVENTION

Field of the Invention

The present invention relates to a dishwasher connectable for single-phase alternating current connection or hookup, in particular a dishwasher for typical designated use in a household, with an electric-motor-driven recirculating pump for wash water and rinse water with which the items to be cleaned are acted upon under a spray pressure.

Particularly in rooms of private homes, the power connection for household appliances is typically constructed for a two-pole single-phase alternating current connection of 230 V, for example, and that nominal value may differ within predetermined limits depending on the connection site and can also vary over time depending on the load on the power grid.

In dishwashers, especially for typical household use, the dishes, such as plates, cups, pots, utensils, and so forth, are placed and spaced apart in dishwashing baskets in the chamber and are acted upon with water at a proper temperature, depending on whether it is a wash cycle or rinse cycle, in such a way that the water is sprayed under pressure onto the surface of the dishes. Besides the temperature and the doses of detergent or rinsing agents, the water spray pressure is an essential variable in treating the dishes to be cleaned. The water pressure is built up by a water recirculating pump, which aspirates the water collected in the bottom region of the chamber from there and sprays it through spray heads and/or rotating spray arms on one or more levels into the chamber and onto the dishes disposed there.

It is known to select the spray pressure acting on the dishes as a function of the type of dishes and the degree of soiling. In any case, the spray pressure should be limited so that sensitive dishes that are present, such as glasses, will not be damaged.

SUMMARY OF THE INVENTION

It is accordingly an object of the invention to provide a dishwasher connectable for single-phase alternating current connection that has a recirculating pump for wash water and rinse water, which overcomes the hereinafore-mentioned disadvantages of the heretofore-known devices of this general type and which does so in such a way that the spray pressure on the dishes to be cleaned can be adapted to the type of dishes and the type of soiling, by controlling the recirculating pump capacity with the least possible energy consumption.

With the foregoing and other objects in view there is provided, in accordance with the invention, a dishwasher equipped for single-phase alternating current connection, in particular a dishwasher for typical designated use in a household, comprising a recirculating pump for wash water and rinse water with which items to be cleaned are acted upon under a spray pressure; a three-phase rotary current motor for driving the recirculating pump; and an electronically controlled single-phase AC/three-phase rotary current/frequency inverter for impressing current on the three-phase rotary current motor.

A dishwasher equipped in accordance with these characteristics of the invention can be connected as usual to the two-pole single-phase outlet for the AC power supply and it is distinguished by good startup performance and comparatively low noise. Due to the correspondingly controlled startup performance, the water pressure in the system of water lines leading to the spray heads and/or spray arms can be metered in a suitable manner. Abrupt performance from surges of water is thus prevented. Moreover, this embodiment of the invention also acts as a prerequisite for other advantageous embodiments.

In accordance with another feature of the invention, the single-phase AC/three-phase rotary current/frequency inverter has a three-phase rotary current generator with a trigger logic for generating a variable rotary current frequency, and the frequency-determining trigger logic is triggered as a function of spray pressure characteristics. Therefore, this water spray pressure is not subject to any random ambient parameters, such as voltage fluctuations in the power supply. Instead, the water spray pressure is purposefully kept substantially constant by readjustment of the variable current frequency, to meet cleaning needs.

In accordance with a further feature of the invention, the trigger logic is triggered by usage-relevant and ambient-relevant data in a frequency-determining manner for the current delivered to the rotary current asynchronous motor. Usage-relevant and ambient-relevant data may, for instance, be the following:

Data that refer to the items to be cleaned, that refer to degrees of soiling or cleaning, or that by way of example are also aligned with respect to noise levels that may be tolerated.

In accordance with an added feature of the invention, the frequency-determining trigger logic is triggered by means of a sensor array that detects the degree of soiling of the water.

In accordance with a concomitant feature of the invention, the frequency-determining trigger logic is triggered by data being input as a function of items to be cleaned.

The structure according to the invention is also especially suitable for a recirculating pump with a motor drive, with which the waste water pumping is also accomplished. The trigger logic for the single-phase AC/three-phase rotary current/frequency inverter is then readily able, in terms of control technology, to align both the direction of rotation and the speed of rotation, or rpm, of the drive motor to optimal usage conditions.

Other features which are considered as characteristic for the invention are set forth in the appended claims.

Although the invention is illustrated and described herein as embodied in a dishwasher connectable for single-phase alternating current connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWINGS

The drawing is a diagrammatic, partly sectional view of a dishwasher with a schematic and block diagram of a circuit for triggering a recirculating pump drive motor.

DESCRIPTION OF THE PREFERRED EMBODIMENTS

Referring now to the single figure of the drawing in detail, there are seen dish baskets 3 disposed on two levels inside a chamber 1 of a household dishwasher 2. Dishes to be cleaned can be disposed in the dish baskets 3. Below each of the two baskets 3 is a respective spray arm 4, from which wash water is sprayed onto the dishes to be cleaned. The spray arms are set into rotation by suitable alignment of their nozzles. Through the use of an electric-motor-driven recirculating pump system 5, rinse water is aspirated from a bottom region 6 of the chamber and delivered under pressure to the spray arms 4 through a pipe system 7.

The circulating pump 5 is driven by a three-phase rotary current motor M which is disposed behind the pump and is therefore shown in broken lines. This three-phase rotary current motor M is controlled and acted upon by power current through an electric single-phase AC/three-phase rotary current/frequency inverter 8. This element 8 includes a trigger logic 8.1 with a protection circuit 8.2 and a three-phase rotary current switching stage 8.3, which is preceded by a smoothing LC combination 8.4. This smoothing LC combination 8.4 is in turn preceded by a power rectifier 8.5.

In a manner which is known per se, the three-phase switching stage 8.3 includes a three-stage power semiconductor array. Each stage includes two series-connected controllable power semiconductor elements. The two series-connected power semiconductor elements of each stage are switched alternatingly into the conducting or blocking state by means of their trigger input, so that by cyclically triggering the three stages of the three-phase switching stage 8.3, a three-phase alternating current is generated from the direct current delivered to this three-phase switching stage 8.3, and this alternating current is delivered to the three-phase rotary current motor M for driving the recirculating pump 5. Although this kind of motor exhibits asynchronous behavior, nevertheless it seeks to synchronously follow the rotary field generated in it with the applied rotary current frequency. In the steady state, only the rotor trails behind the impressed rotary field, with a variable trailing angle. Thus the frequency applied is responsible to a great extent for the attained drive speed of the three-phase rotary current motor M, and therefore for the pumping capacity and attained pumping pressure of the recirculating pump 5.

Triggering of the three-phase rotary current switching stage 8.3, which is performed as a function of signals of a microprocessor 9, can be performed by suitable power control modules. The microprocessor 9 is connected to the trigger logic 8.1 of the three-phase alternating current switching stage 8.3 of the frequency converter 8 through a potential separation circuit 10 and the protection circuit 8.2. The potential separation is preferably performed with the use of an optical coupler.

The power rectifier 8.5 is connected on the input side to an AC source (230 V AC), of the kind that is typically available, especially in the household, from the public power supply, through two-pole outlets with protective parts. Disposed between the AC source and the power rectifier 8.5 is an interference suppressor 12, which maximally shields the power supply, in particular a public power supply, from high-frequency-type interference from the appliance, or conversely acts against such interference. Thus mutual interference of appliances in the close-together surroundings of the household is also counteracted.

In the present case, the microprocessor 9 is connected to two sensors S1 and S2. The sensor S1 is equipped as a pressure sensor and is disposed in the pipe system or water duct 7 leading from the recirculating pump 5 to the spray arms 4, while the sensor S2 is disposed in the bottom region 6 of the chamber 1 and is constructed for measuring the degree of soiling of the water. Sensors for other variables that appear important, such as temperature sensors for monitoring the motor load, may also be connected to the microprocessor.

Values are also delivered to the microprocessor 9 by a person using the appliance, through an analog and/or digital input E1, E2. These values correspond the estimation and wishes of the user about what the initial situation is in terms of the type and degree of soiling of the dishes and what cleaning outcome is to be attained.

The microprocessor 9 may be assigned a memory module, which operates as a function of the desired rinsing and cleaning process to also periodically lead to a change in the spray water pressure by means of variable triggering of the single-phase AC/three-phase rotary current/frequency inverter 8 in terms of the frequency of the three-phase alternating current.

Both the microprocessor 9 and the other trigger modules are supplied in a known manner with the required smoothed low-voltage direct current through a power supply stage 11.

We claim:

1. A dishwasher equipped for single-phase alternating current connection, comprising:

a recirculating pump for wash water and rinse water with which items to be cleaned are acted upon under a spray pressure;

a three-phase rotary current motor for driving said recirculating pump; and an electronically controlled single-phase AC/three-phase rotary current/frequency inverter for impressing current on said three-phase rotary current motor, said single-phase AC/three-phase rotary current/frequency inverter having a three-phase rotary current generator with a trigger logic for generating a variable rotary current frequency, and said frequency-determining trigger logic being triggered as a function of spray pressure characteristics; and a pressure sensor disposed in a water duct leading away from said recirculating pump for measuring the spray pressure of the wash water and rinse water.

2. The dishwasher equipped for single-phase alternating current connection according to claim 1, wherein said trigger logic is triggered by usage-relevant and ambient-relevant data in a frequency-determining manner for current delivered to said rotary current asynchronous motor.

3. The dishwasher equipped for single-phase alternating current connection according to claim 1, wherein said frequency-determining trigger logic is triggered by data being input as a function of items to be cleaned.

4. The dishwasher equipped for single-phase alternating current connection according to claim 1, wherein said frequency-determining trigger logic is triggerable as a function of water soiling.

* * * * *